US010556738B2

(12) United States Patent
Speck

(10) Patent No.: US 10,556,738 B2
(45) Date of Patent: Feb. 11, 2020

(54) TWO AEROSOL CAN INJECTION SYSTEM

(71) Applicant: James H. Speck, Campbellville (CA)

(72) Inventor: James H. Speck, Campbellville (CA)

(73) Assignee: Pro Form Products Ltd., Milton, Ontario (CA)

( * ) Notice: Subject to any disclaimer, the term of this patent is extended or adjusted under 35 U.S.C. 154(b) by 0 days.

(21) Appl. No.: 16/014,610

(22) Filed: Jun. 21, 2018

(65) Prior Publication Data

US 2018/0297772 A1 Oct. 18, 2018

Related U.S. Application Data

(63) Continuation-in-part of application No. 15/473,972, filed on Mar. 30, 2017.

(60) Provisional application No. 62/341,862, filed on May 26, 2016.

(51) Int. Cl.

| | |
|---|---|
| ***B65D 83/42*** | (2006.01) |
| ***B65B 3/12*** | (2006.01) |
| ***B65D 83/20*** | (2006.01) |
| ***B65D 83/68*** | (2006.01) |
| *B65D 83/14* | (2006.01) |
| *B65B 31/00* | (2006.01) |

(52) U.S. Cl.

CPC ..... *B65D 83/425* (2013.01); *B65B 3/12* (2013.01); *B65D 83/205* (2013.01); *B65D 83/682* (2013.01); *B65B 31/003* (2013.01); *B65D 83/7532* (2013.01)

(58) Field of Classification Search

CPC .. B65D 83/425; B65D 83/205; B65D 83/682; B65D 83/7532; B65B 3/12; B65B 31/003

See application file for complete search history.

(56) References Cited

U.S. PATENT DOCUMENTS

| | | | | |
|---|---|---|---|---|
| 3,181,737 | A * | 5/1965 | Chaucer | B65D 83/42 222/136 |
| 3,343,718 | A * | 9/1967 | Siegel | B01F 15/0201 222/1 |
| 4,202,470 | A * | 5/1980 | Fujii | B05C 17/0316 141/20 |
| 4,988,017 | A | 1/1991 | Schrader et al. | |
| 2017/0341851 | A1* | 11/2017 | Speck | B65D 83/682 |

FOREIGN PATENT DOCUMENTS

| | | |
|---|---|---|
| CA | 2707355 A1 | 3/2009 |
| WO | WO 9943441 A1 | 9/1999 |

OTHER PUBLICATIONS

International Search Report and Written Opinion for PCT/CA2017/050389, Authorized Officer: Harvey Berg, Completion of International Search Report: Jun. 8, 2017, Completion of Written Opinion: Jun. 9, 2017, ISA/CA (Canada), 7 pages.

* cited by examiner

*Primary Examiner* — P. Macade Nichols

(74) *Attorney, Agent, or Firm* — Fay Sharpe LLP; James E. Scarbrough

(57) ABSTRACT

A two aerosol can injection system has a first aerosol can containing product and propellant; a second aerosol can containing activator or hardener; and a connector connected at a first end to the first aerosol can and at a second end to the second aerosol can. The connector has a first internal thread valve connected to the first aerosol can, and a second internal thread valve connected to the second aerosol can.

13 Claims, 20 Drawing Sheets

(EXISTING)

(EXISTING)

TWO AEROSOL CAN INJECTION SYSTEM

CLAIM OF PRIORITY

This application is a Continuation-in-Part application of application Ser. No. 15/473,972 filed on Mar. 30, 2017, which claims priority to Provisional Patent Application Ser. No. 62/341,862 filed on May 26, 2016, the entirety of each is hereby incorporated by reference.

BACKGROUND OF THE DISCLOSURE

The present disclosure relates to the art of filling and injecting pressurized containers. In particular, It finds application with a two aerosol can injection system which injects activator or hardener from one aerosol can into a second aerosol can which has been previously charged with liquefied propellants and filled with products such as, but not limited to, paints, primers, clearcoats, adhesives, resins or coatings and will be described with particular reference thereto.

It is to be appreciated, however, that the present disclosure may also find application in conjunction with injecting other coating systems, including, but not limited to lubricants, fiberglass resins, SMC resins, adhesives, epoxy, urethane adhesives, and any other products which can be catalyzed or activated and dispensed from aerosol cans.

There are presently two existing methods for filling an aerosol container with propellant, namely, a) an "under the cup" or out of the valve cup method which lifts the valve mounting cup and b) a "pressure filling" method.

In under the cup filling, a filling head actually lifts the valve cup partially out of the aerosol container and the propellant is driven under pressure through the opening between the bead (opening) of the container and the channel or circular skirt of the valve cup. In pressure filling, after product is placed in the aerosol can, the valve is crimped onto a one-inch diameter opening of the can. Then, propellant is charged into the can through the valve.

One disadvantage of using existing filling heads is the heads are not typically portable and the filling process must occur at the head location rather than in the field. Another disadvantage is that the filling heads are expensive.

Still another disadvantage of a filling head is that it is difficult to provide sufficient pressure to inject the activator into the valve of the aerosol can.

Thus, there is a need for a new improved method of injecting activator or hardener from one aerosol into a aerosol can which has propellant and product. The present disclosure provides a new and improved portable aerosol can filling and injecting system which overcomes the above-referenced deficiencies of the prior systems while providing better and more advantageous overall results.

SUMMARY OF THE DISCLOSURE

In accordance with one embodiment of the disclosure, a two aerosol can system is provided that is easily portable and can be readily used in the field. Another aspect of the two aerosol can system is that it is inexpensive. Yet another advantage of the two aerosol can system is that it allows the mixing of a activator and product at the time of use, this preventing curing of the coating on product in the can.

In accordance with another embodiment of the disclosure, a two aerosol can injection system is adapted to be easily used with a male valve on the activator can and the female valve on the product can, or vice versa.

In accordance with another embodiment of the disclosure, a two aerosol can injection system injects activator or hardener from one aerosol can into a second aerosol can which has been previously charged with liquefied propellants and filled with products such as, but not limited to, paints, primers, clearcoats, adhesives, resins or coatings and will be described with particular reference thereto.

In accordance with a preferred embodiment of the disclosure, a two aerosol can injection system has a first aerosol can containing product and propellant; a second aerosol can containing activator or hardener; and a connector connected at a first end to the first aerosol can and at a second end to the second aerosol can; wherein the connector has a first internal thread valve connected to the first aerosol can, and a second internal thread valve connected to the second aerosol can.

In accordance with another embodiment of the disclosure, a method of injecting an aerosol can using a two aerosol can system has the following steps: providing a first aerosol can containing product and propellant; providing a second aerosol can containing activator or hardener; removing a spray head from the first aerosol can; attaching a locking mechanism to a top of a female valve on the first can; locking the locking member on the first can by rotating a locking arm of the locking member; threading an external thread valve into a threaded opening of the locking mechanism; threading an internal thread valve onto a male threaded member on the second aerosol can; inserting a tip of a first male valve into the external thread valve and inserting a tip of a second male valve into the internal thread valve; threading a first shut-off valve onto the first male valve; threading a second shut-off valve onto the second male valve; threading a first hose coupler onto the first shut-off valve; threading a second hose coupler onto the second shut-off valve; threading the first hose coupler onto a first end of a tube; threading the second hose coupler onto a second end of the tube; opening the second shut-off valve to send activator or hardener through the tube to the first shut-off valve; opening the first shut-off valve to allow the activator or hardener contents to flow into the first can.

In accordance with another embodiment of the disclosure, two aerosol cans may be used for injecting other coating systems, including, but not limited to lubricants, fiberglass resins, SMC resins, adhesives, epoxy, urethane adhesives, and any other products which can be catalyzed or activated and dispensed from aerosol cans.

Still another aspect of the disclosure is the use of two aerosol cans for injection between the cans.

Still further aspects of the present disclosure will become apparent upon reading and understanding the following detailed description of the preferred embodiments.

BRIEF DESCRIPTION OF THE DRAWINGS

The disclosure may take form in various parts and arrangements of parts. The drawings are only for purposes of illustrating a preferred embodiment and are not to be construed as limiting the disclosure.

DETAILED DESCRIPTION OF THE PREFERRED EMBODIMENTS

Figure 1:
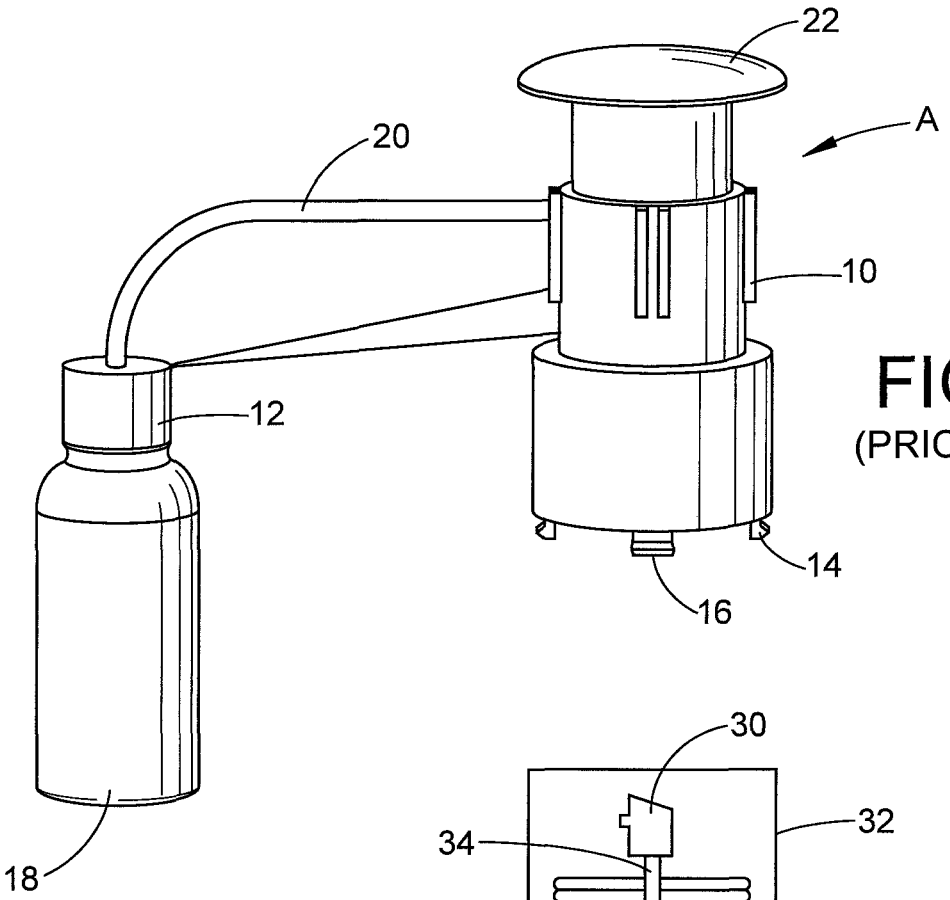
FIG. 1 (PRIOR ART)
FIG. 1 is a perspective view of an existing aerosol can filling pump.

Referring to FIG. 1, the use of an existing manual spray pump A in an aerosol can includes the following steps: First, the spray head is removed from the aerosol can. Then, a washer 10 is removed from the side of the pump and inserted into the bottle flange 12. A collar lock 14 is turned counterclockwise to expose prongs 16, which are snapped onto the top of the aerosol can. While the pump assembly is held in one hand, the lock collar is turned clockwise with the other hand to lower the pump onto the can. The collar is tightened snugly. The bottle 18 is filled with a reducer, catalyst or hardener and screwed into the bottle flange. A dip tube 20 has a length which is adjusted so that it is touching the bottom of the bottle. The can is placed on a hard surface. The plunger 22 is firmly pressed down to pump the material from the bottle into the aerosol can. The material in the bottle is sucked into the dip tube on the upward stroke and is pushed into the aerosol can on the downward stroke. The appropriate amount of catalyst is pumped into the can plus one extra pump, which allows for the catalyst in the dip tube that never gets mixed in with the paint. Each bottle holds about 1.5 or 2 fluid ounces and each stroke is about a quarter of an ounce. The catalyzed paint must be used within 20 hours of pumping the catalyst into the can.

Figure 2:
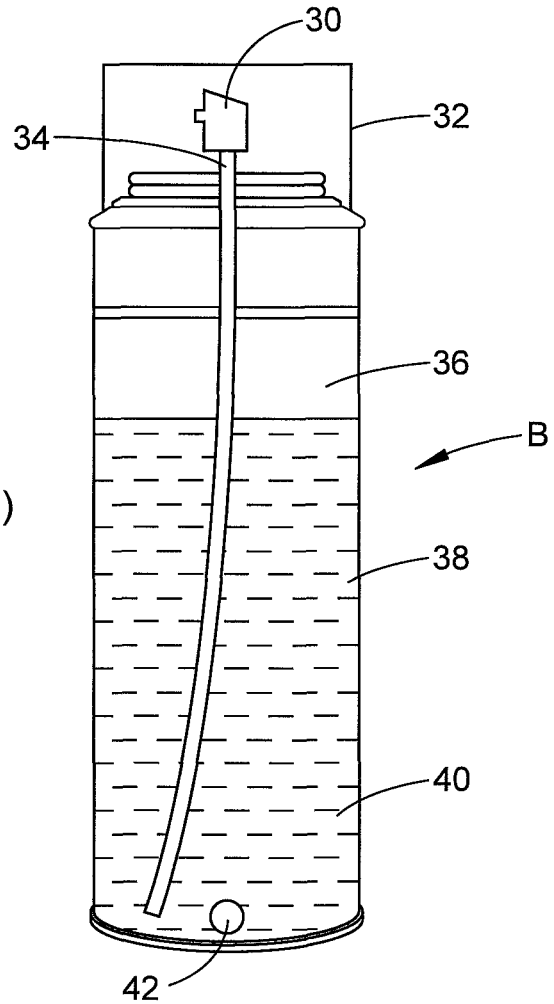
FIG. 2 (PRIOR ART)
FIG. 2 is a side elevational view illustrating an aerosol can.

Referring now to FIG. 2, an aerosol can B typically has seven main components: a sprayhead (actuator) 30; a cap 32; a valve and dip tube 34; propellant 36; product or coating 38 such as paint, a gel, an adhesive or an epoxy; a can body 40 and a mixing ball 42 (which rattles when shaken). The propellant drives the product or coating out through the valve at the top of the can at a pressure of about 50 to 60 lbs. Aerosol cans are typically supplied in 4-ounce, 6-ounce, 8-ounce, 12-ounce, 16-ounce, 20-ounce, 24-ounce and 32-ounce sizes.

Figure 3:
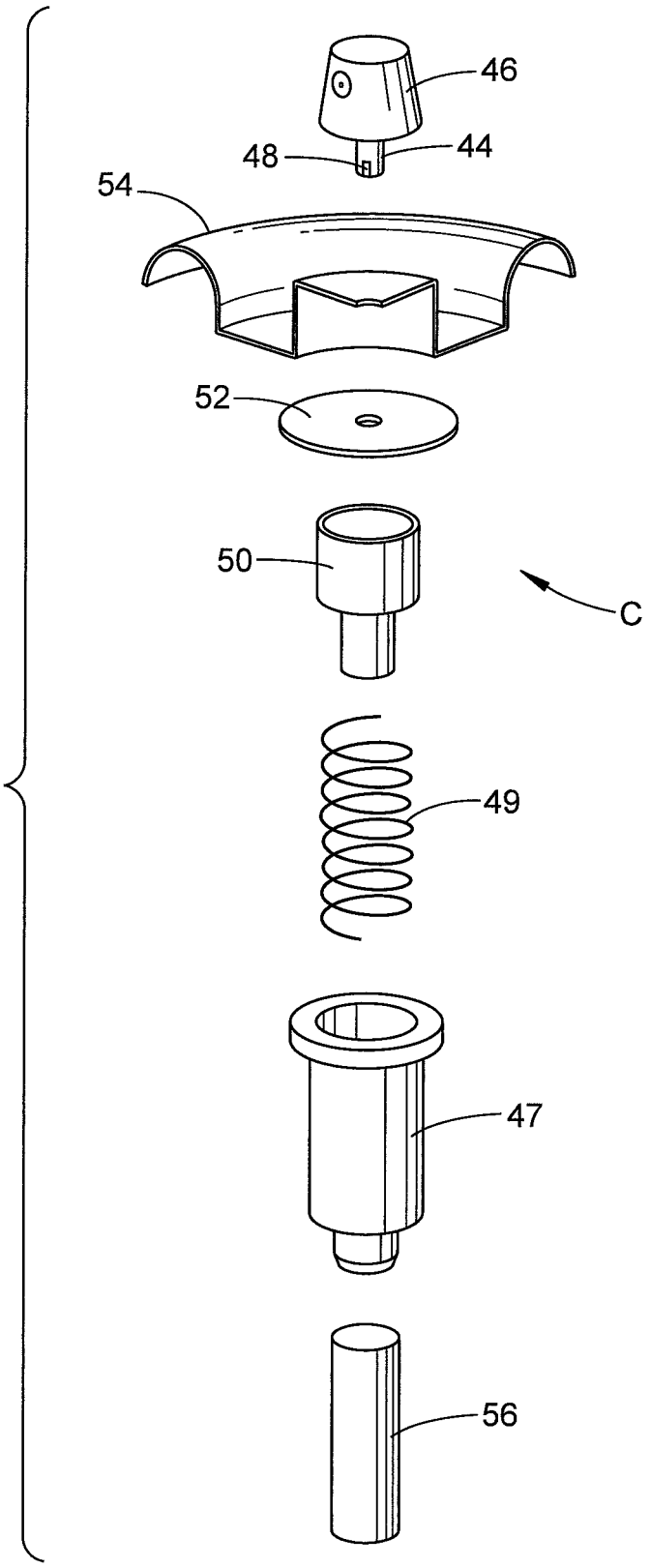
FIG. 3 is an exploded view of an existing female aerosol valve assembly.

Referring to FIG. 3, an existing female valve assembly C which is often used with paints, adhesives and resins is shown. This type of valve is used because the sprayhead can be easily removed and cleaned. The stem 44 on the female valve is located on the sprayhead or actuator 46 and the metering slot 48 on the stem determines the amount of product that is sprayed. To clean the sprayhead, a pin or knife is used on the slot at the base of the sprayhead. Once the blockage is cleared, the sprayhead can be placed back into the valve and used again. The sprayhead is placed into position with a twist and push action.

In the usual aerosol can or container, product and propellant are placed in a valved container. Referring still to FIG. 3, a valve body 47, a spring 49, a spring cup 50, a gasket 52, and a mounting cup 54 and dip tube 56 together form the valve assembly and are all crimped onto the top opening of an aerosol can. The opening is typically one inch in diameter. The valve stem 44 emerges through the pedestal portion of the container closure or mounting cup 54. The actuator 46 is frictionally fitted to the valve stem; the actuator being the component that receives manual pressure from the user of the aerosol container to actuate or open the valve and, thereby, to cause egress of the container contents. The spring head or activator is depressed which in turn causes the container contents to exit the can.

Figure 4:
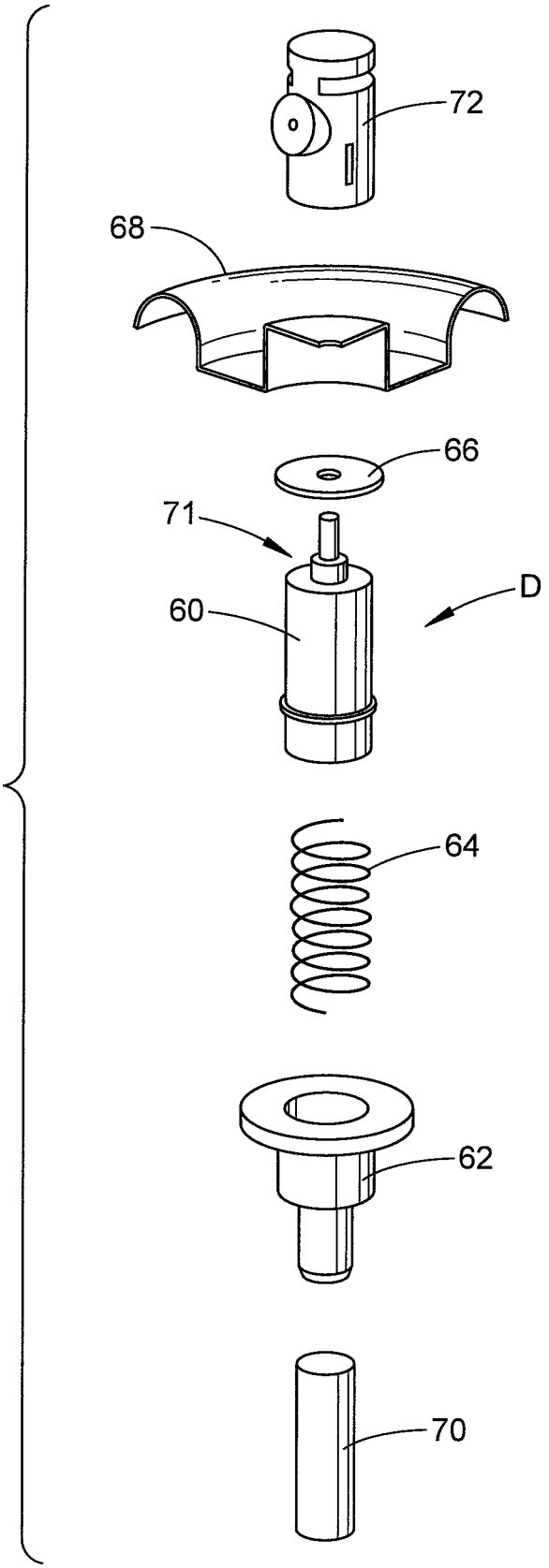
FIG. 4 is an exploded view of an existing male aerosol valve assembly.

Referring now to FIG. 4, a typical male valve assembly D is shown. The male valve also has a stem 60, valve body 62, a spring 64, a gasket 66, and a mounting cup 68 and dip tube 70 which are all crimped onto a can. However, the metering slot 71 for a male valve is located on the stem of the valve itself. That is, the male sprayhead 72 does not have a stem. To clean the male valve, a thin knife is used to clear the blockage. The sprayhead is cleaned and reattached.

With reference now to FIGS. 5-21, a two aerosol can injection and filling system in accordance with a preferred embodiment of the disclosure is shown.

Figure 5:
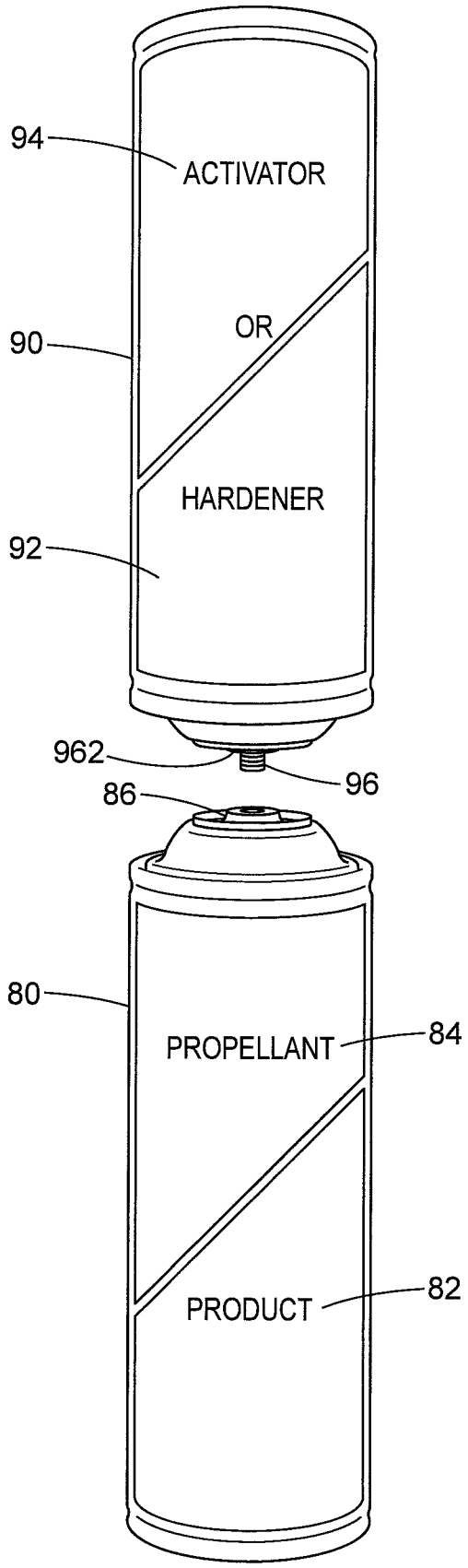
FIG. 5 is a perspective view of two aerosol cans in accordance with a preferred embodiment of the present disclosure.

Referring now to FIG. 5, a first or product aerosol can 80 can be filled with product 82 and propellant 84 and has a valve such as female valve 86. A second, or activator aerosol can 90 can be filled with hardener 92 or activator 94 and has a male threaded member 96.

The two aerosol can injection system injects activator or hardener from can 90 into can 80 which has been previously charged with liquefied propellants 84 and filled with products 82 such as, but not limited to, paints, primers, clearcoats, adhesives, resins or coatings and will be described with particular reference thereto.

The present disclosure may also find application in conjunction with injecting other coating systems, including, but not limited to lubricants, fiberglass resins, SMC resins, adhesives, epoxy, urethane adhesives, and any other products which can be catalyzed or activated and dispensed from aerosol cans.

Figure 6:
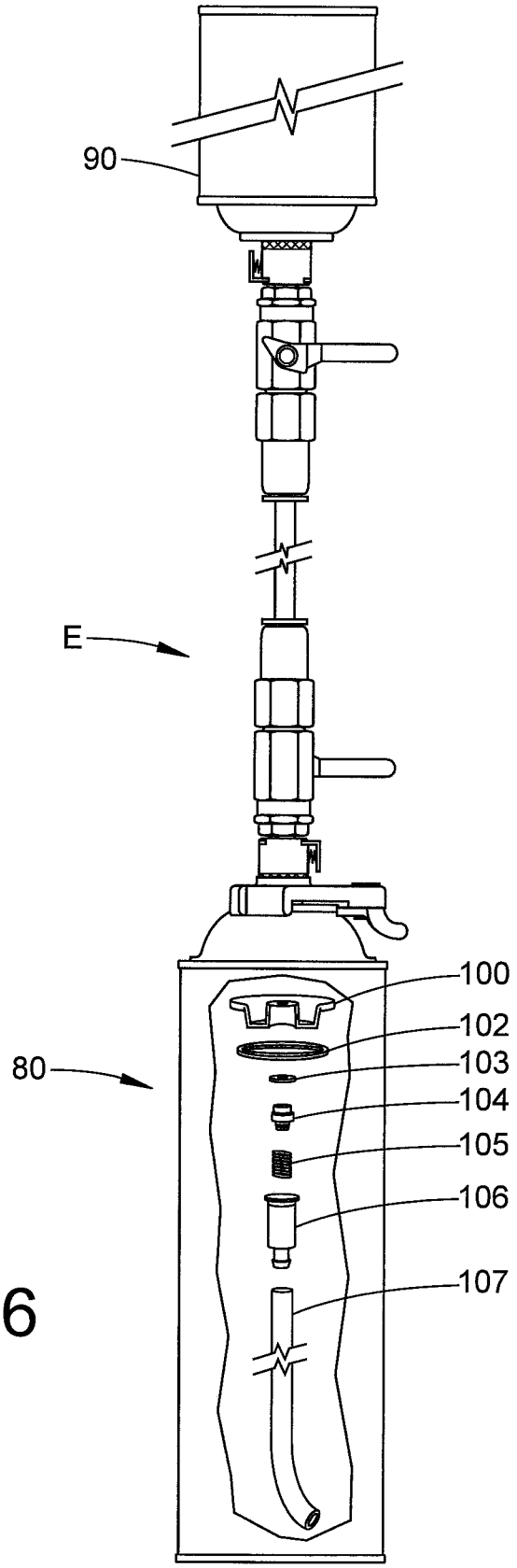
FIG. 6 is a side elevated view in partially exploded view of the two aerosol can system including a connector in accordance with a preferred embodiment of the disclosure.
Figure 7:
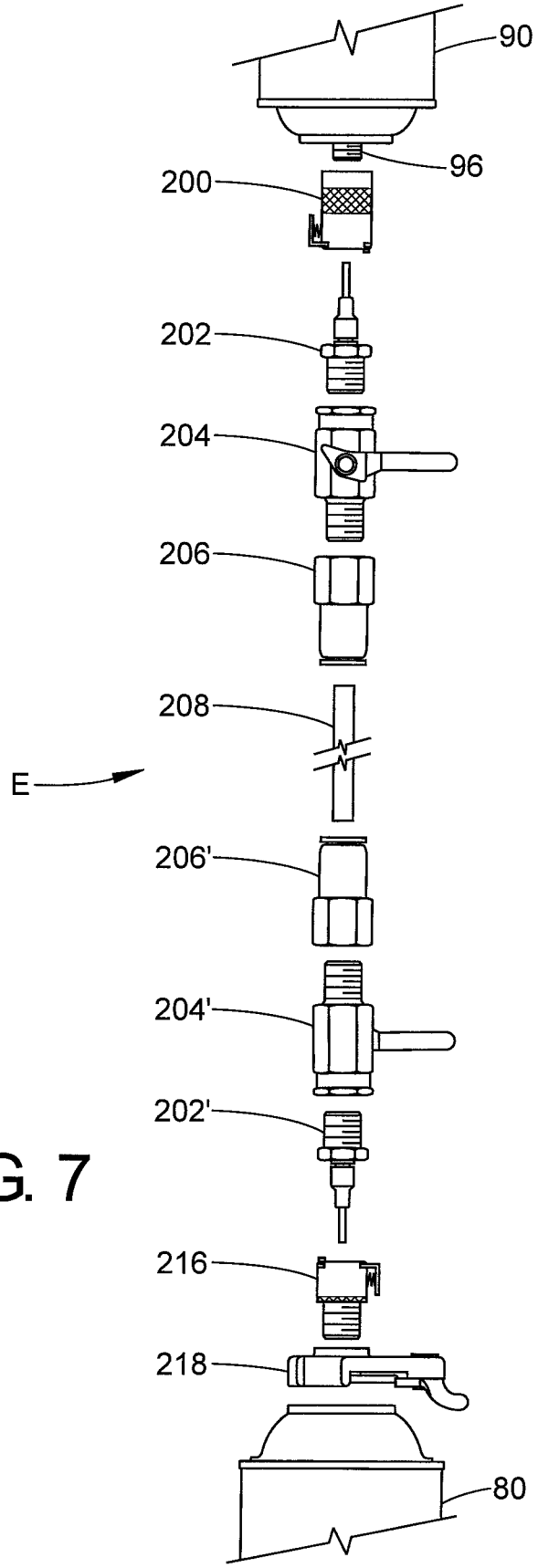
FIG. 7 is an exploded elevational view of the two aerosol can filling assembly of FIG. 6.

Referring now to FIGS. 6 and 7, a two aerosol can injection and filling connector system E in accordance with a preferred embodiment of the disclosure is shown. This embodiment utilizes first can 80 with product 82 and propellant 84 and second can 90 with hardener 92 or activator 94.

Aerosol can 80 with product 82 and propellant 84 therein can be various sizes, such as 16 (sixteen) ounces. However, other size cans are contemplated by the disclosure. Referring to FIG. 6, the internals of the can 80 are a mounting cup 100, an external gasket 102, an internal gasket 103, a stem 104, a spring 105, a housing 106 and a dip tube 107 housed therein. The can preferably contains product 82 or such as paint or primer or clear coat or dip as well as propellant 84.

The second can 90 is preferably a two ounce (2 oz.) or six ounce (6 oz.) high pressure aerosol can other sizes of can 80 are also contemplated. There is no dip tube in the can. The can contains activator 94 or hardener 92. A connecting device E has a threaded connector on one side and a male valve in a locking mechanism on the other side. The device is controlled by a valve at both ends. The hardener or activator flows from the can 90 to the can 80.

Before attaching the device E to an aerosol can, both shut-off valves 204, 204' must be in the fully off position. The spray head cap 81 is removed from the can 80 (see FIG. 14B). Locking mechanism 218 is attached to the top of the female valve 86 on the can 80. The threaded aerosol male valve 216 is screwed into the threaded opening 228 on the top of the locking connector 218. This activates the internal female valve and releases pressure to the shut-off valve.

The threaded male hub 96 of the can 90 is screwed into the internally threaded openings on the female aerosol valve 200. This results in opening of the valve 200 which releases activator out of the can. The can must not be removed once the valve is opened.

Once both cans 80, 90 are connected to the device E and pressure is held at the shut-off valves 204, 204', both valves 204, 204' are opened simultaneously at the same time to equalize the pressure. The higher pressure of the can 90 will force the activator content down a rigid airline tube 208 into the can 80 where it mixes with lower pressure content. Once the system is equalized, the can 90 can be removed from the system by releasing a locking connector.

Referring now to FIG. 7, the specific components of the connecting device E are as follows: an internal thread aerosol valve 200 which is attached to can 90; a first male aerosol valve 202; a first shut-off valve 204; a first hose coupler 206; a rigid airline hose or tube 208; a second hose coupler 206'; a second shut-off valve 204'; a second male aerosol valve 202'; an external thread aerosol valve 216 attached to can 80; and an aerosol container locking mechanism 218 attached to can 80. Parts 202', 204', 206' are essentially identical to parts 202, 204, 206, thus, the description herein for parts 202, 204, 206 applies to parts 202', 204', 206'.

Referring to FIGS. 8A-13B, details of the components used in the system are shown.

Figure 8A:
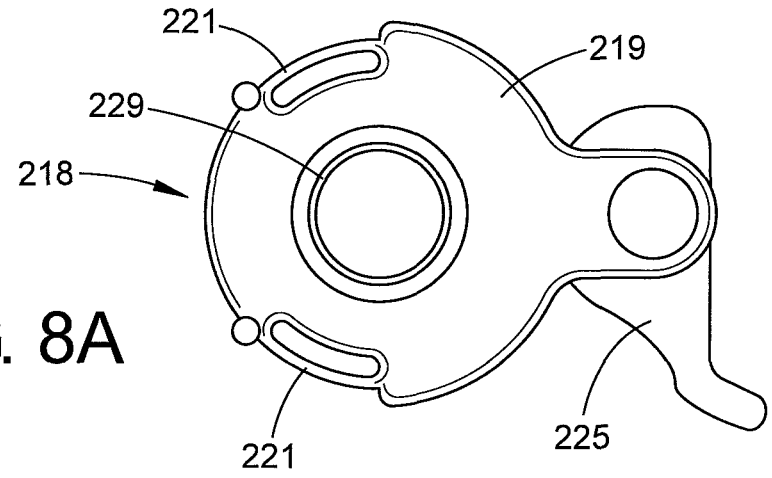
FIG. 8A is a top plan view of an aerosol container locking mechanism in accordance with another embodiment of the disclosure.
Figure 8B:
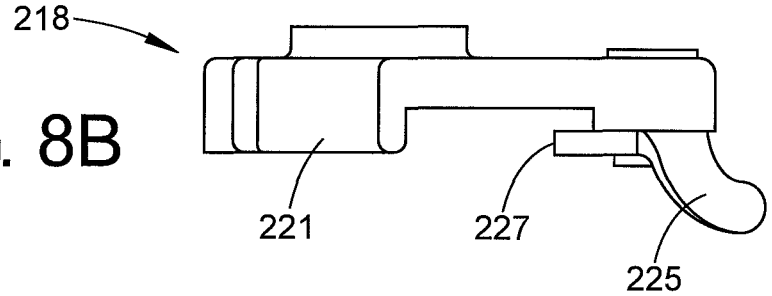
FIG. 8B is a side elevational view of the locking mechanism of FIG. 8A.

Referring to FIGS. 8A and 8B, the details of the aerosol container locking mechanism 218 are shown. The mechanism has a body 219 which has ridges or ledges or ribs 221 which matingly engage upper end 223 of can 80. The mechanism 218 has a locking tab 225 which is rotated to lock the mechanism onto the upper end 223 of can 80 via edge 227. A threaded opening 229 is found in a central portion of the mechanism.

Figure 9A:
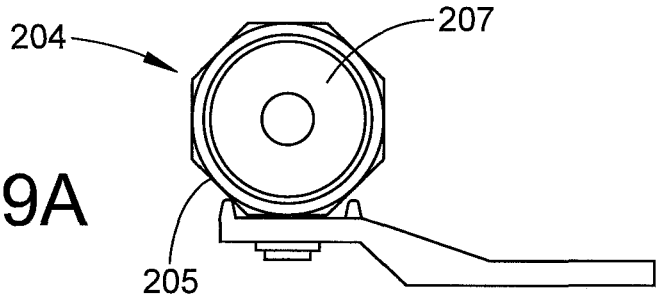
FIG. 9A is a top plan view of a shut-off valve in accordance with another embodiment of the disclosure.
Figure 9B:
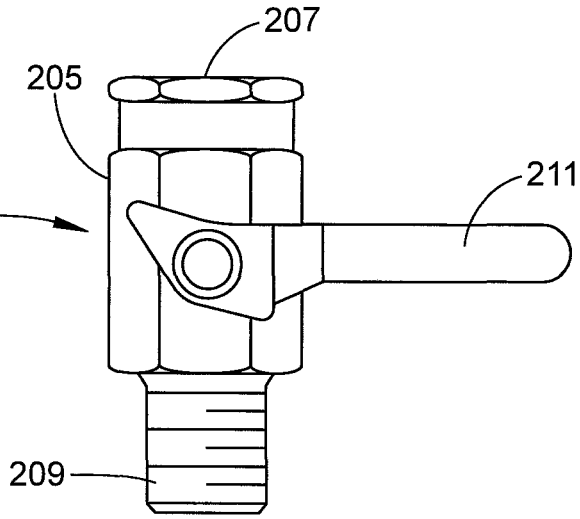
FIG. 9B is a side elevated view of the shut-off valve of FIG. 9A.

Referring to FIGS. 9A and 9B, the details of the shut-off valve 204 are shown. Shut-off valve 204 has a body 205, a threaded opening 207 at an upper end and a threaded member 209 at a lower end. A rotating or pivoting arm 211 rotates up and down between valve open and valve closed positions. Upper threaded opening 207 receives a threaded portion of the male valve, which threaded member 207 is received by a threaded opening of hose coupler 206.

Figure 10A:
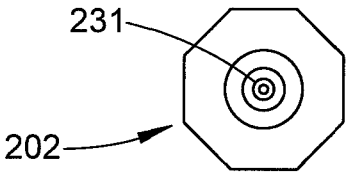
FIG. 10A is a top plan view of a male aerosol valve.
Figure 10B:
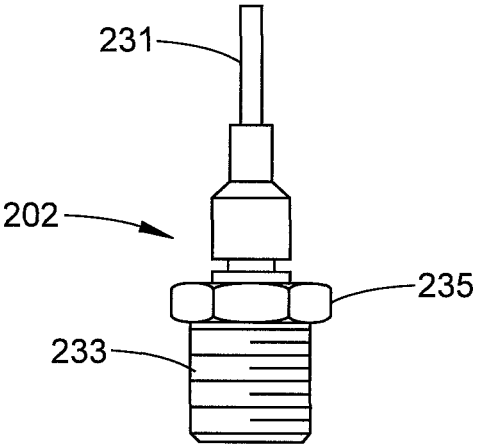
FIG. 10B is a side elevational view of the male aerosol valve of FIG. 10A.

Referring to FIGS. 10A and 10B, the details of the male aerosol valve 202 are shown. Specifically, valve 202 has a tip 231 which is inserted into an opening in internal thread female aerosol valve 200 or an opening of external thread male aerosol valve 216. Threaded portion 233 of valve 202 extends from housing 235 is threaded into threaded opening of hose coupler 206.

Figure 11A:
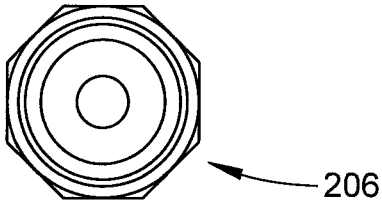
FIG. 11A is a top plan view of a hose coupler in accordance with an embodiment of the disclosure.
Figure 11B:
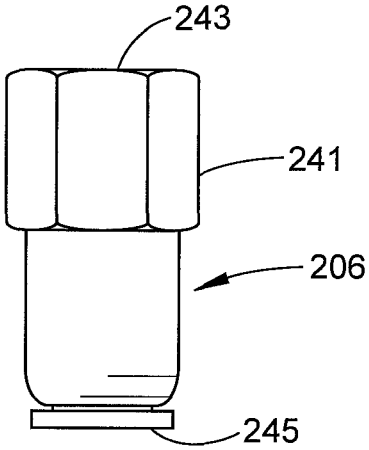
FIG. 11B is a side elevational view of the hose coupler of FIG. 11A.

Referring to FIGS. 11A and 11B, the details of hose coupler 206 are shown. Hose coupler 206 has a body 241, a first threaded opening 243 and a second threaded opening 245. First threaded opening 243 receives threaded portion 233 of male valve 202, while second threaded opening 245 receives an end of rigid airline tube 208.

Figure 12A:
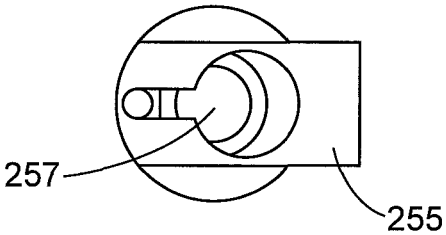
FIG. 12A is a top plan view of an internal thread male aerosol valve in accordance with another embodiment of the disclosure.
Figure 12B:
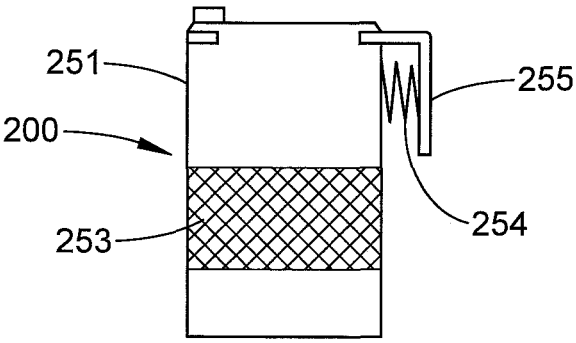
FIG. 12B is a side elevational view of the valve of FIG. 12A.

Referring now to FIGS. 12A and 12B, the details of internal thread aerosol valve 200 are shown. The valve 200 has a body 251, which has an internal threaded opening 253, and a spring (spring 254) loaded shut-off member 255 which opens and closes the valve opening 257. Valve 200 is inserted into aerosol can 90.

Figure 13A:
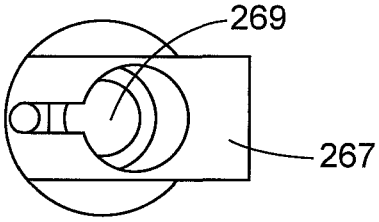
FIG. 13A is a top plan view of an external thread male aerosol valve in accordance with an embodiment of the disclosure.
Figure 13B:
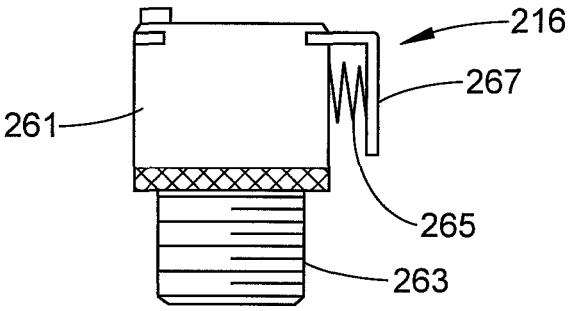
FIG. 13B is a side elevational view of the male aerosol valve of FIG. 13A.

Referring now to FIGS. 13A and 13B, the details of the external thread male aerosol valve 216 are shown. Valve 216 has a body 261, and external threads 263, and a spring (spring 265) loaded shut-off member 267 which opens and closes the valve opening 269. Valve 216 is inserted into aerosol can 80.

Figure 14A:
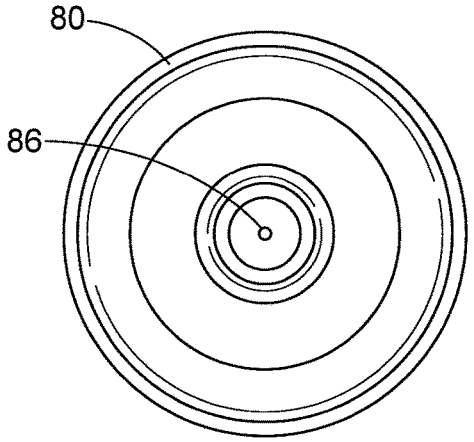
FIG. 14A is a top plan view of an aerosol can in accordance with an embodiment of the disclosure.
Figure 15A:
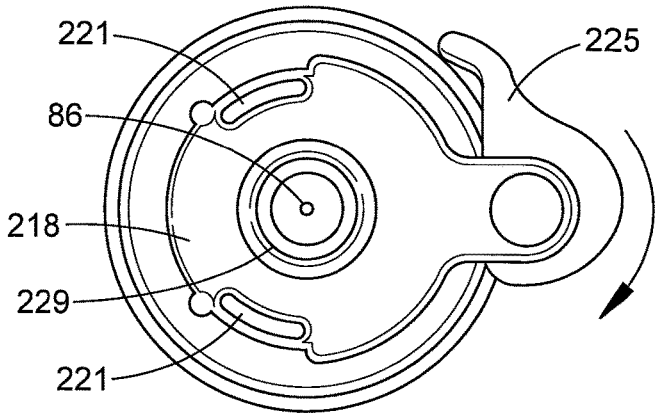
FIG. 15A is a top plan view of a locking mechanism in a locked position on the top of the aerosol can of FIG. 14A.
Figure 14B:
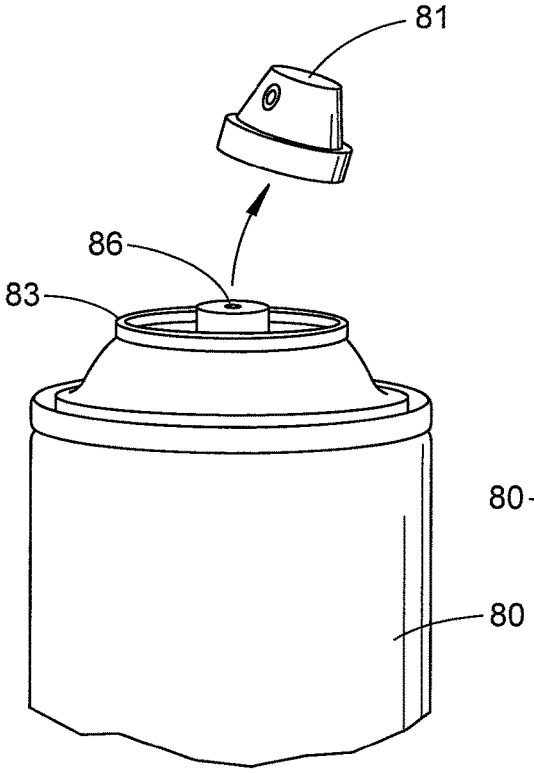
FIG. 14B is a perspective view of a top portion of an aerosol can in accordance with an embodiment of the disclosure.
Figure 15B:
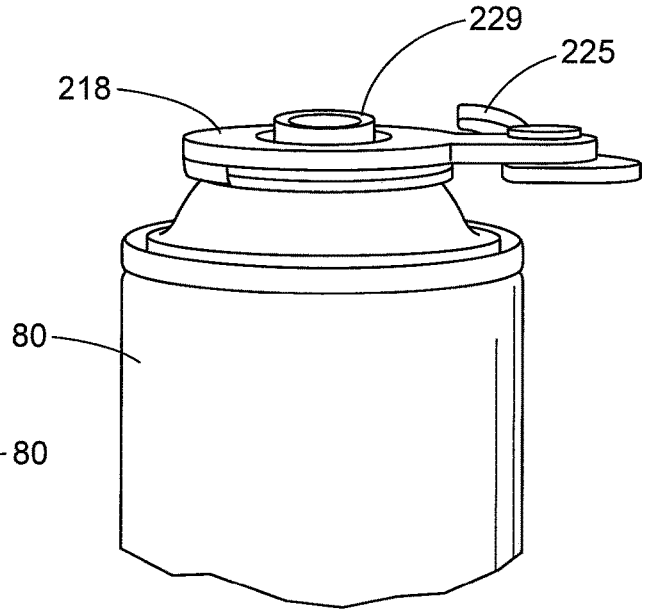
FIG. 15B is a perspective view of the locking mechanism of FIG. 15A on an aerosol can.
Figure 16A:
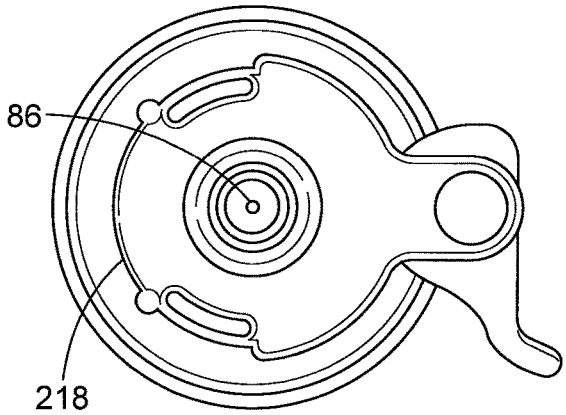
FIG. 16A is a top plan view of the locking mechanism in an unlocked position on the top of the aerosol can.
Figure 17A:
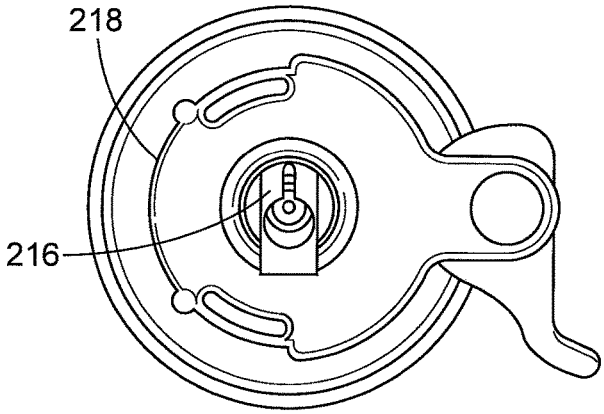
FIG. 17A is a top plan view of the aerosol can with the threaded male valve connection and locking member installed on the can.
Figure 16B:
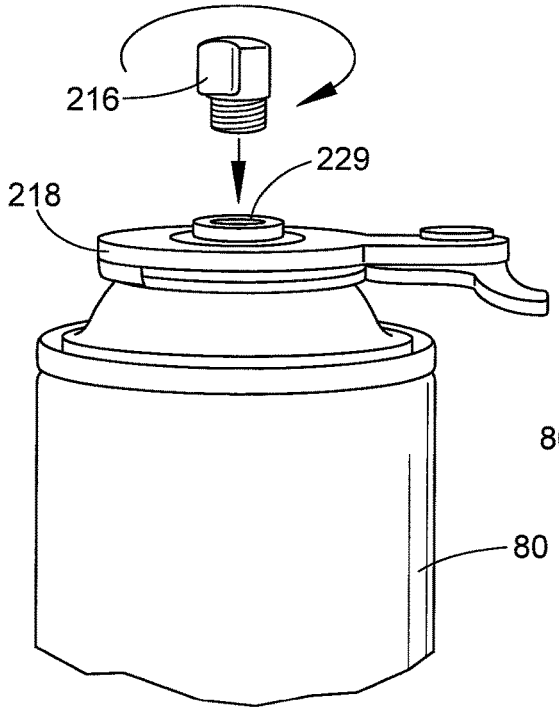
FIG. 16B is a side perspective view of an aerosol can installing a threaded male connection onto the can.
Figure 17B:
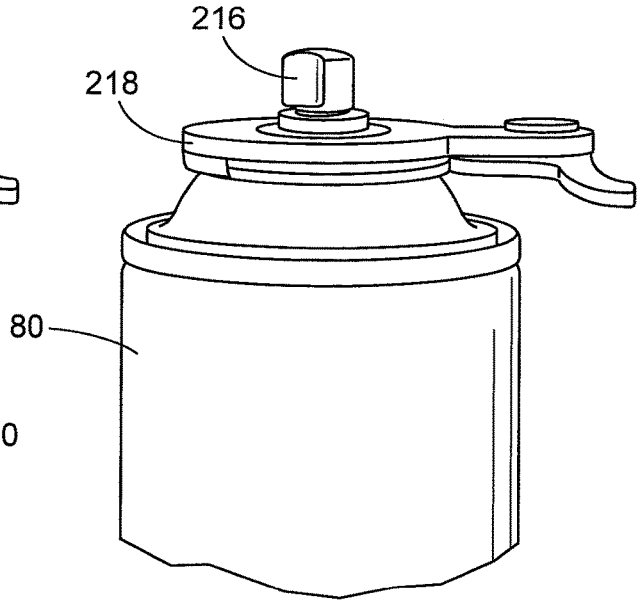
FIG. 17B is a side perspective view of FIG. 17A.

Referring now to FIGS. 14A-21, the steps involved with priming and connecting the cans 80, 90 together are as shown. Referring to FIGS. 14A and 14B, to prepare the product can 80, the cap and spray head 81 are removed from the can 80, exposing the female valve 86. Referring to FIGS. 15A and 15B, the locking mechanism 218 is then attached to the top of the female valve 86 on the can 80 by placing the locking mechanism 218 on top of the can, engaging upper end 83 of the can via ridges 221 and swinging the locking arm 225 hand-tight to the left (clockwise as shown by arrow in FIG. 15A) to lock the mechanism in place. The locking mechanism is the first and last piece on and off in the system. The locking mechanism serves to hold and secure valve 216 onto the can 80 and to provide a sealed configuration.

Referring to FIGS. 16A, 16B, 17A and 17B, the threaded aerosol male valve connector 216 is screwed into the threaded opening 229 on the top of the locking connector 218, hand tight only. The metal stem height of the aerosol can vary from product to product, so the connector will be long enough to cover any length. The male valve 216 connection is tightened until contact with the internal valve 86 is tight (this may vary from can to can).

Figure 18A:
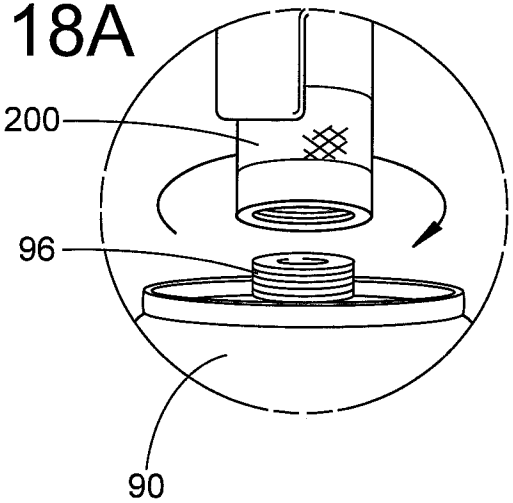
FIG. 18A is a perspective view of a threaded female valve being installed over the threaded male opening of the activator can.
Figure 18B:
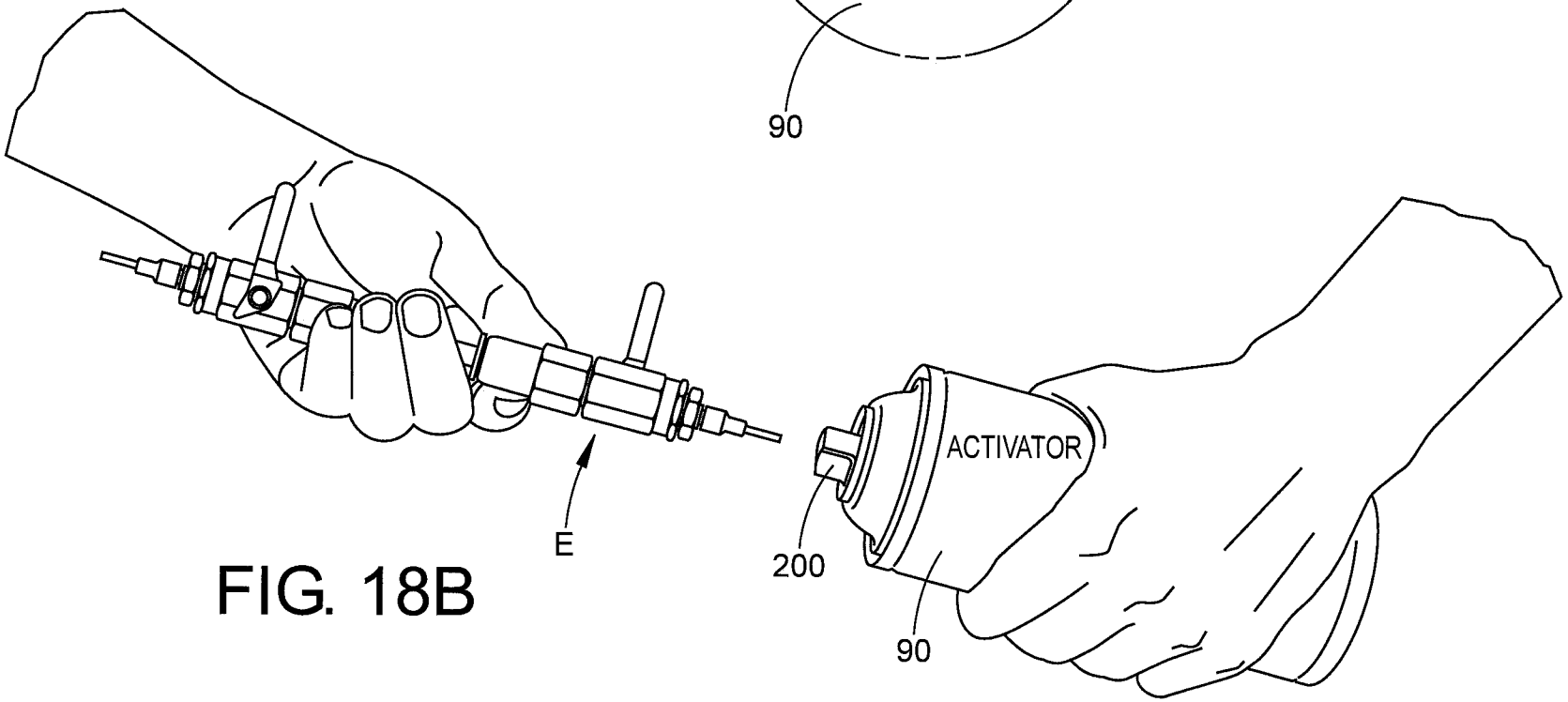
FIG. 18B is a perspective view of the connector being inserted into the activator aerosol can.

Referring to FIGS. 18A and 18B, to prepare the activator can 90, the threaded aerosol female valve 200 is screwed over threaded male member 96 on the top of the can 90. This is also done hand-tight only.

Figure 19:
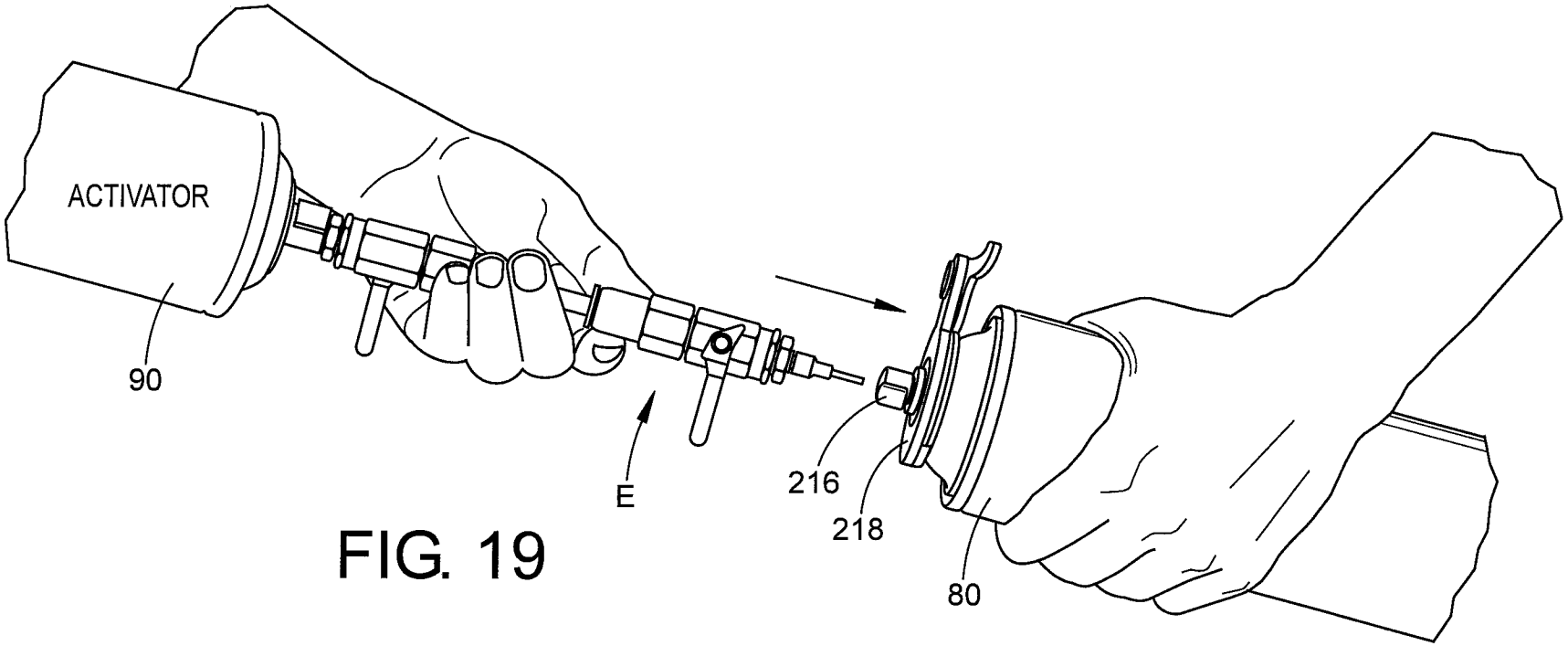
FIG. 19 is a perspective view of the connector being inserted into the product aerosol can.

To connect the cans, before starting, both of the shut-off valves 204, 204' must be in the closed position. That is, the swing arms 211, 211' will be perpendicular to the device when closed. Once both cans are prepped with the appropriate housings, the core of E the device can then be inserted. Referring to FIG. 18B, one side of the device E is pressed into the connector housing 200 on the can 90. This will be pushed down until a "click" noise is heard and the device is locked. This activates the internal female valve 200 and releases the pressure to the shut-off valve 204. Referring to FIG. 19, the connection is completed by pressing the other side of the device E into the housing 216 on the can 80. Pressure is released to the shut-off valve 204'. The assembly is now completely assembled.

Figure 20:
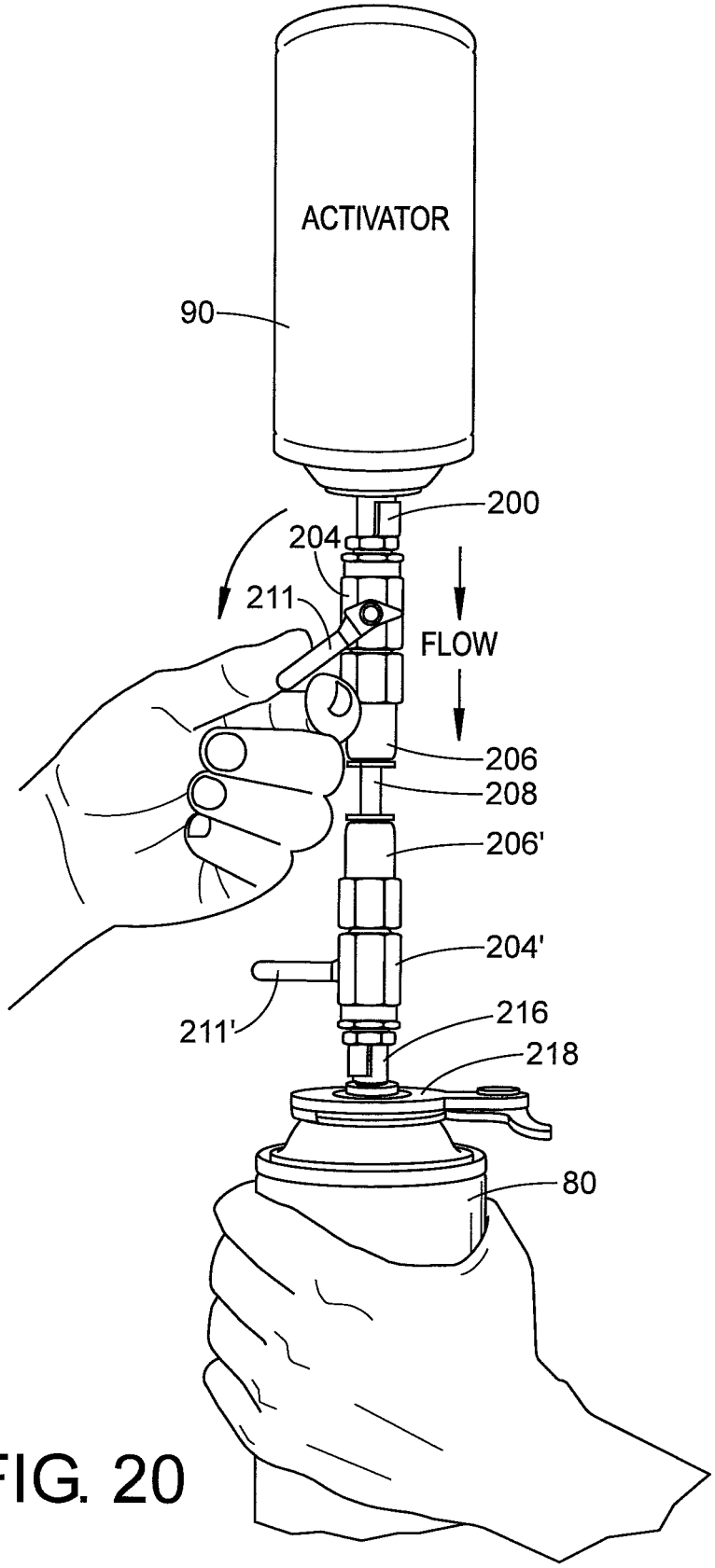
FIG. 20 is a side elevational view of the connector and the aerosol can with the valve being opened to allow flow from the activator can.
Figure 21:
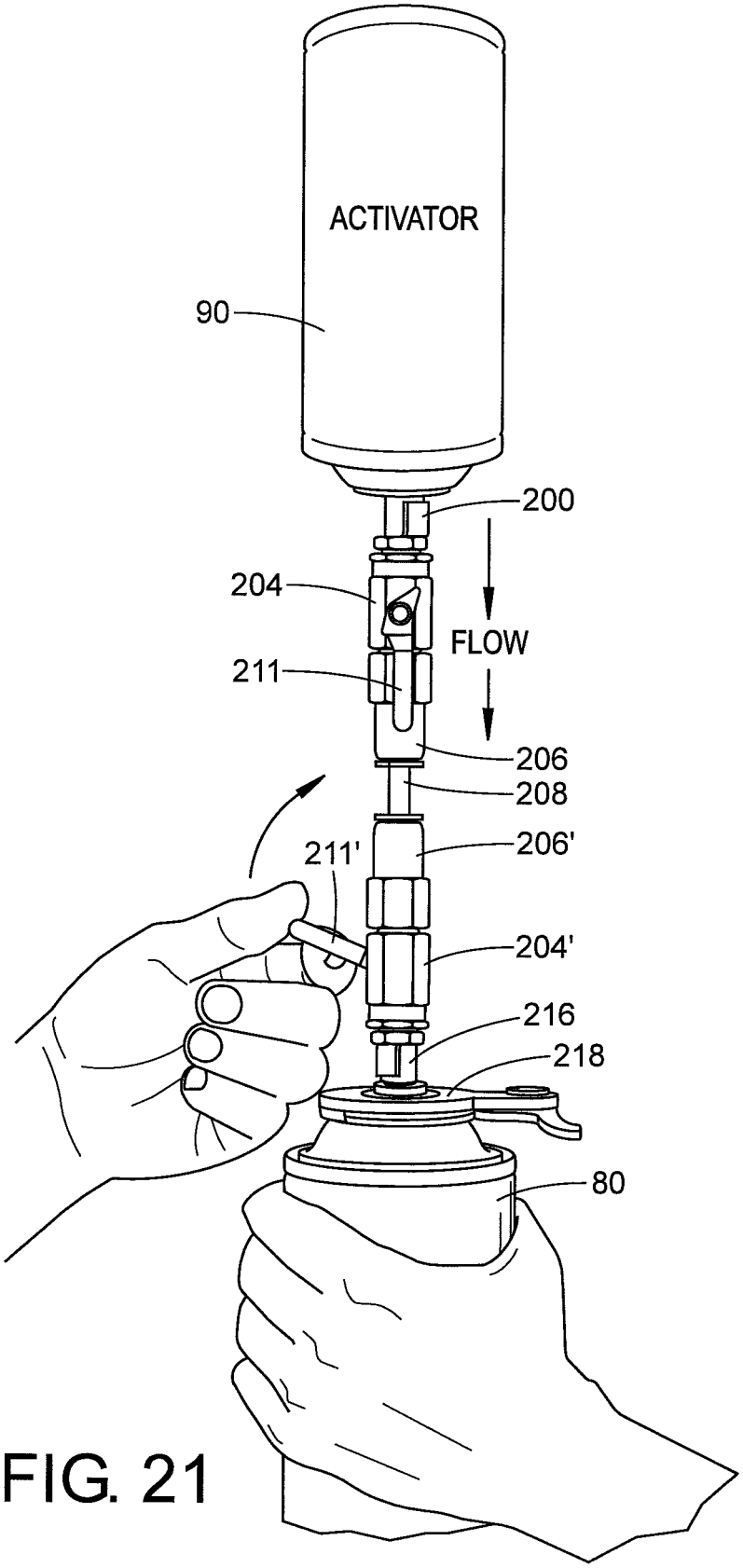
FIG. 21 is a side elevational view of the connector and the aerosol can with the valve being opened to the product can to allow flow into the product can.

Referring to FIG. 20, once both cans 80, 90 are connected to the device E and pressure is held at the shut-off valves 204, 204', the valve 204, closer to the activator can 90 is opened by rotating arm 211 counter-clockwise, sending the activator or hardener contents through tube 208 to the shut-off valve 204' closer to the product can 80. Referring to FIG. 21, then the valve 204' is opened to can 80, rotating arm 211' clockwise, allowing the higher pressure of the activator can 90 to force the activator or hardener contents into can 80. The result is the higher pressure of the can 90 will force the activator content down through the airline tube 208 into the can 80, where it then mixes with the lower pressure content of can 80.

The product can 80 can be removed from the system by first releasing the lock tab 225 on the connector 218. First, the housing 216 must be unscrewed and removed from the locking mechanism 218, then the lock tab 225 is rotated, thus releasing the locking mechanism 218 from can 80. The spray nozzle 81 is then reapplied to the can and it is ready to be used in its intended application.

Figure 22:
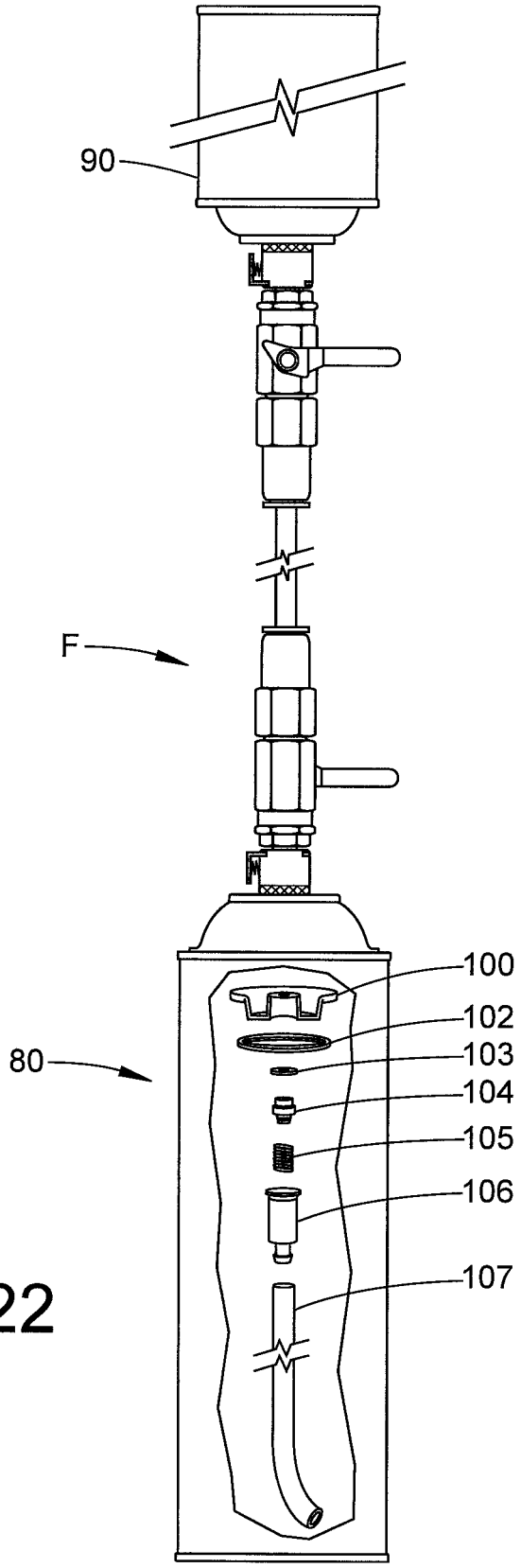
FIG. 22 is a side elevational view and a partially exploded view of a two aerosol can filling system including a connector in accordance with another embodiment of the disclosure.
Figure 23:
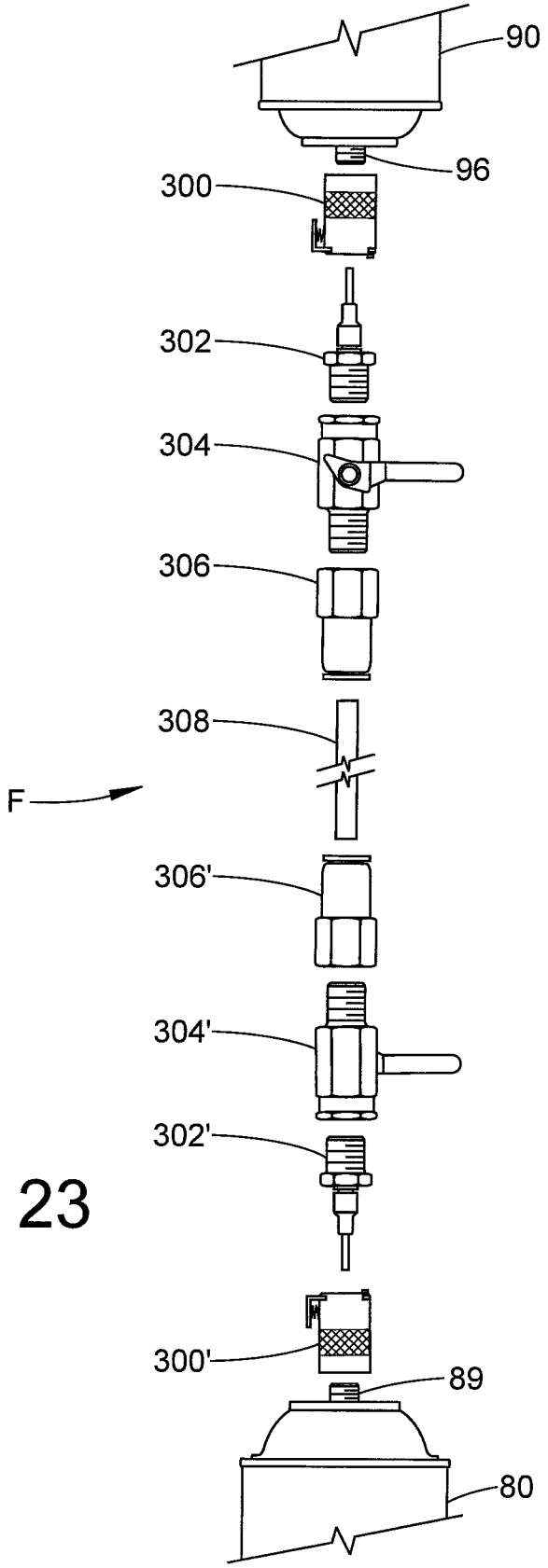
FIG. 23 is an exploded elevational view of the two aerosol can filling system assembly of FIG. 22.

Referring now to FIGS. 22 and 23, a two aerosol can injection and filling connector system F in accordance with another preferred embodiment of the disclosure is shown. This embodiment also utilizes first can 80 with product 82 and propellant 84 and second can 90 with hardener 92 or activator 94.

Aerosol can 80 with product 82 and propellant 84 therein can be various sizes, such as 16 (sixteen) ounces. However, other size cans are contemplated by the disclosure. Referring to FIG. 22, the internals of the can 80 are a mounting cup 100, an external gasket 102, an internal gasket 103, a stem 104, a spring 105, a housing 106 and a dip tube 107 housed therein. The can preferably contains product 82 or such as paint or primer or clear coat or dip as well as propellant 84.

The second can 90 is preferably a two ounce (2 oz.) or six ounce (6 oz.) high pressure aerosol can other sizes of can 80 are also contemplated. There is no dip tube in the can. The can contains activator 94 or hardener 92. A connecting device F has threaded connectors on each side. The device is controlled by a valve at both ends. The hardener or activator flows from the can 90 to the can 80.

Referring now to FIG. 23, the specific components of the connecting device F are as follows: an internal thread aerosol valve 300 which is attached to can 90; a first male aerosol valve 302; a first shut-off valve 304; a first hose coupler 306; a rigid airline hose or tube 308; a second hose coupler 306'; a second shut-off valve 304'; a second male aerosol valve 302'; and a second internal thread aerosol valve 300' attached to can 80. Parts 300' 302', 304', 306' are essentially identical to parts 300, 302, 304, 306, thus, the description herein for parts 300, 302, 304, 306 applies to parts 300', 302', 304', 306'. Before attaching the device F to an aerosol can, both shut-off valves 304, 304' must be in the fully off position. The spray head cap 81 is removed from the can 80 (see FIG. 14B).

The threaded male hub 96 of the can 90 is screwed into the internally threaded openings on the female aerosol valve 300. This results in opening of the valve 300 which releases activator out of the can. The can must not be removed once the valve is opened. Similarly, threaded male hub 89 of can 80 is screwed into the internally threaded openings and female aerosol valve 300'.

Once both cans 80, 90 are connected to the device F and pressure is held at the shut-off valves 304, 304', both valves 304, 304' are opened simultaneously at the same time to equalize the pressure. The higher pressure of the can 90 will force the activator content down a rigid airline tube 308 into the can 80 where it mixes with lower pressure content. Once the system is equalized, the can 90 can be removed from the system by releasing a locking connector.

Figure 24A:
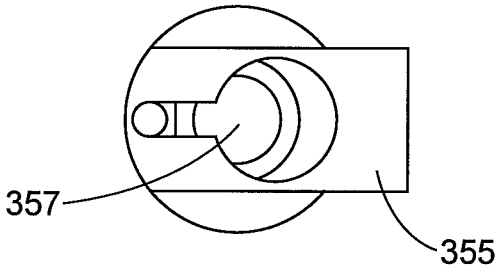
FIG. 24A is a top plan view of an internal thread male aerosol valve used with the system of FIG. 22.
Figure 24B:
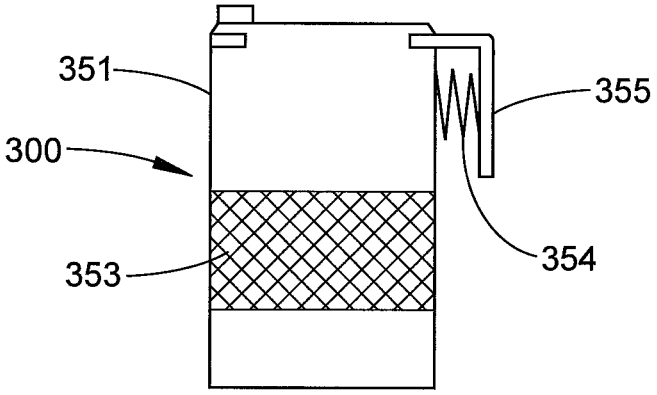
FIG. 24B is a side elevational view of the valve of FIG. 24A.

Referring now to FIGS. 24A and 24B, the details of internal thread aerosol valve 300 are shown. The valve 300 has a body 351, which has an internal threaded opening 353, and a spring (spring 354) loaded shut-off member 355 which opens and closes the valve opening 357. Valve 300 is inserted into aerosol can 90.

Figure 25A:
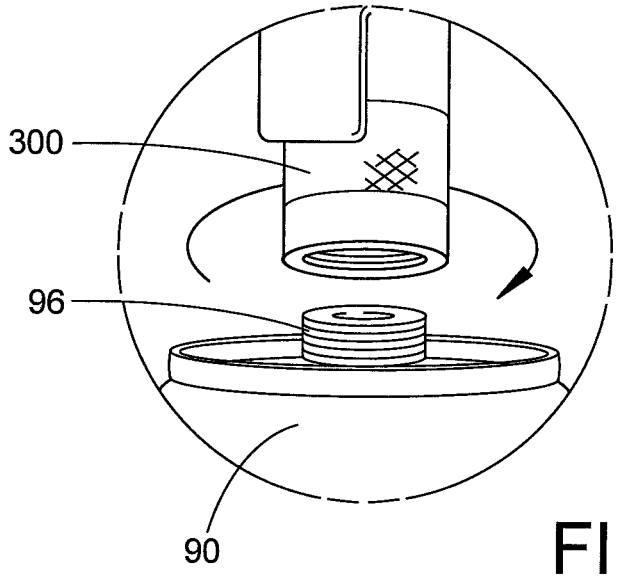
FIG. 25A is a perspective view of a threaded female valve being inserted over the threaded male opening of the activator can.
Figure 25B:
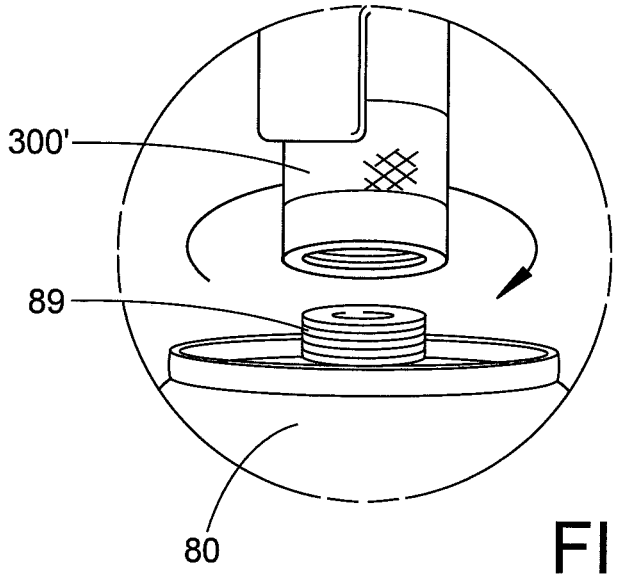
FIG. 25B is a perspective view of a threaded female valve being inserted over the threaded male opening of the product can.

Referring to FIGS. 25A and 25B, to prepare the activator can 90, the threaded aerosol female valve 300 is screwed over threaded male member 96 on the top of the can 90. This is also done hand-tight only. The product can 80 has threaded female valve 300' screwed over threaded male member 89 of can 80. This is done hand-tight only.

To connect the cans, before starting, both of the shut-off valves 304, 304' must be in the closed position. That is, the swing arms 311, 311' will be perpendicular to the device when closed. Once both cans are prepped with the appropriate housings, the core of the device F can then be inserted. Referring to FIG. 25B, one side of the device F is pressed into the connector housing 300 on the can 90. This will be pushed down until a "click" noise is heard and the device is locked. This activates the internal female valve 300 and releases the pressure to the shut-off valve 304. Referring to FIG. 25B, the connection is completed by pressing the other side of the device F into the housing 316 on the can 80. Pressure is released to the shut-off valve 304'. The assembly is now completely assembled.

Figure 26:
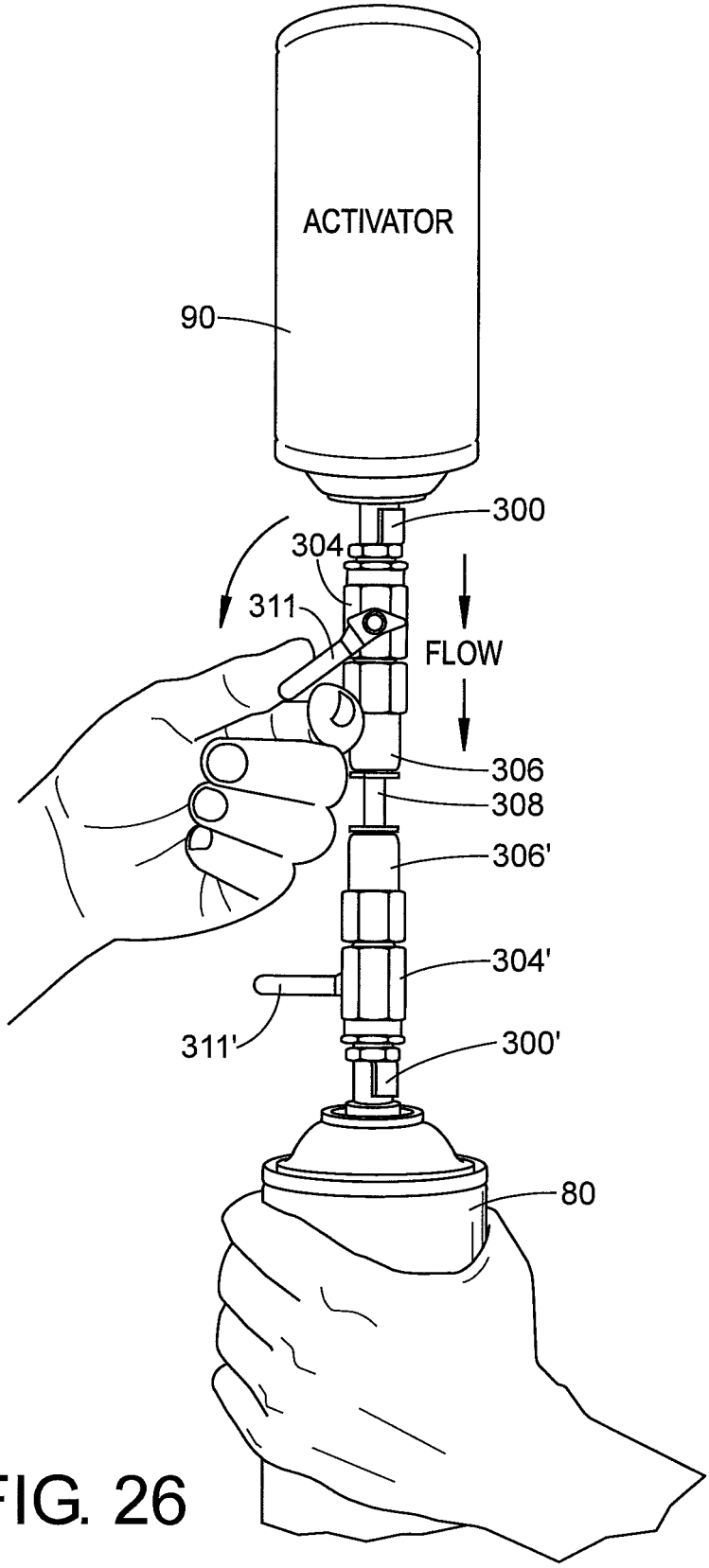
FIG. 26 is a side elevational view of the connector and the aerosol can of FIG. 22 with the valve being opened to allow flow from the activator can.

Referring to FIG. 26, once both cans 80, 90 are connected to the device F and pressure is held at the shut-off valves 304, 304', the valve 304, closer to the activator can 90 is opened by rotating arm 311 counter-clockwise, sending the activator or hardener contents through tube 308 to the shut-off valve 304' closer to the product can 80.

Figure 27:
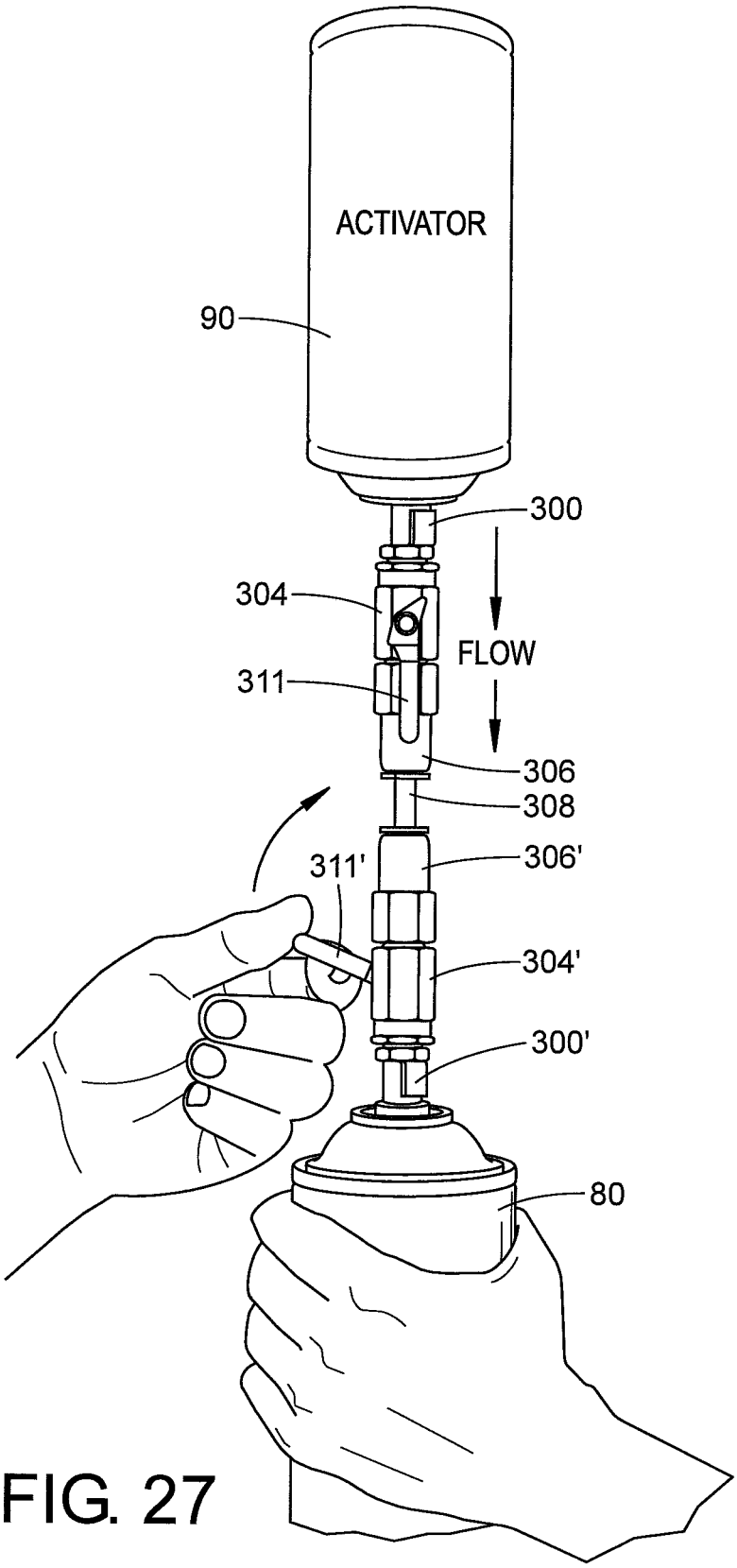
FIG. 27 is a side elevational view of the connector and the aerosol can of FIG. 22 with the valve being opened to the product can to allow flow into the product can.

Referring to FIG. 27, then the valve 304' is opened to can 80, rotating arm 311' clockwise, allowing the higher pressure of the activator can 90 to force the activator or hardener contents into can 80. The result is the higher pressure of the can 90 will force the activator content down through the airline tube 308 into the can 80, where it then mixes with the lower pressure content of can 80.

The exemplary embodiments have been described with reference to the preferred embodiments. Obviously, modifications and alterations will occur to others upon reading and understanding the preceding detailed description. It is intended that the exemplary embodiment be construed as including all such modifications and alterations insofar as they come within the scope of the above described embodiments or the equivalents thereof.

What is claimed is:

1. A two aerosol can injection system, comprising:

a first aerosol can containing product and propellant;

a second aerosol can containing activator or hardener; and a connector connected at a first end to said first aerosol can and at a second end to said second aerosol can; wherein said connector comprises a first internal thread valve connected to said first aerosol can, and a second internal thread valve connected to said second aerosol can further comprising a locking mechanism attached to said first aerosol can, said locking mechanism comprising ribs.

2. The two aerosol can injection system of claim 1, wherein said connector further comprises a first male valve connected to said first internal thread valve and a second male valve connected to said second internal thread valve.

3. The two aerosol can injection system of claim 2, wherein said connector comprises a first shut-off valve connected to said first male valve and a second shut-off valve connected to said second male valve.

4. The two aerosol can injection system of claim 3, wherein said connector further comprises a first hose coupler connected to said first shut-off valve and a second hose coupler connected to said second shut-off valve.

5. The two aerosol can injection system of claim 4, wherein said connector further comprises a tube extending between said first hose coupler and said second hose coupler.

6. The two aerosol can injection system of claim 1, wherein said first internal thread valve comprises a body having an internal threaded opening and a spring loaded shut-off member.

7. The two aerosol can injection system of claim 6, wherein said second internal thread valve comprises a body having an internal threaded opening and a spring loaded shut-off member.

8. The two aerosol can injection system of claim 2, wherein said first male valve and said first male valve each comprises a tip which is inserted into an opening of one of said first internal thread valve and said internal second thread valve.

9. The two aerosol can injection system of claim 3, wherein said first shut-off valve and said second shut-off valve each comprises a body having threaded opening at a first end and a threaded opening at a second end, and a pivoting arm which rotates between valve open and valve closed positions.

10. The two aerosol can injection system for claim 6, wherein each of said hose couplers comprises a body having first and second threaded openings.

11. The two aerosol can injection system of claim 1, wherein said first aerosol can contains one of the following products: paints, clear coats, primer, adhesive resin and coating.

12. A method of injecting an aerosol can using a two aerosol can system, comprising:

providing a first aerosol can containing product and propellant;

providing a second aerosol can containing activator or hardener;

removing a spray head from said first aerosol can; attaching a locking mechanism to a top of a female valve on said first aerosol can; locking said locking member on said first can by matingly engaging ribs with said first aerosol can;

threading a first internal thread valve into a threaded opening of said first aerosol can mechanism;

threading a second internal thread valve into a threaded opening on said first internal second aerosol can;

inserting a tip of a first male valve into said internal thread valve and inserting a tip of a second male valve into said second internal thread valve;

threading a first shut-off valve onto said first male valve;

threading a second shut-off valve onto said second male valve;

threading a first hose coupler onto said first shut-off valve;

threading a second hose coupler onto said second shut-off valve;

threading said first hose coupler onto a first end of a tube;

threading said second hose coupler onto a second end of said tube;

opening said second shut-off valve to send activator or hardener to said first shut-off valve through said tube;

opening said first shut-off valve to allow said activator or hardener contents to flow into said first can.

13. The method of claim 12, wherein said first shut-off valve and said second shut-off valve each comprises a body having threaded opening at a first end and a threaded opening at a second end, and a pivoting arm which rotates between valve open and valve closed positions.

* * * * *